US007287710B1

(12) United States Patent
Nelson et al.

(10) Patent No.: US 7,287,710 B1
(45) Date of Patent: Oct. 30, 2007

(54) SPRINKLER WITH MAGNETIC NUTATING MECHANISM AND RELATED METHOD

(75) Inventors: Craig Nelson, Walla Walla, WA (US); Lee A. Perkins, Lowden, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 0 days.

(21) Appl. No.: 11/490,066

(22) Filed: Jul. 21, 2006

(51) Int. Cl.
*B05B 3/04* (2006.01)

(52) U.S. Cl. ..... 239/222.17; 239/DIG. 11

(58) Field of Classification Search ..... 239/222.11, 239/222.17, DIG. 11
See application file for complete search history.

(56) References Cited

U.S. PATENT DOCUMENTS

| | | | |
|---|---|---|---|
| 2,848,276 | A | 8/1958 | Clearman |
| 3,034,728 | A | 5/1962 | Hruby, Jr. |
| 3,532,273 | A | 10/1970 | Siddal et al. |
| 3,958,643 | A | 5/1976 | Landsberg |
| 3,964,685 | A | 6/1976 | Chauvigne |
| 4,073,438 | A | 2/1978 | Meyer |
| 4,487,368 | A | 12/1984 | Clearman |
| 5,381,960 | A | 1/1995 | Sullivan et al. |
| 5,439,174 | A | 8/1995 | Sweet |
| 5,588,595 | A | 12/1996 | Sweet et al. |
| 5,671,885 | A | 9/1997 | Davisson |
| 5,950,927 | A | 9/1999 | Elliott et al. |
| 6,092,739 | A | 7/2000 | Clearman et al. |
| 6,129,293 | A | 10/2000 | Jager |
| 6,176,440 | B1 | 1/2001 | Elliott |
| 6,267,299 | B1 | 7/2001 | Meyer |
| 6,382,525 | B1 | 5/2002 | Santiesteban et al. |
| 6,431,475 | B1 | 8/2002 | Williams |
| 6,439,477 | B1 | 8/2002 | Sweet et al. |
| 6,932,279 | B2 | 8/2005 | Burcham |
| 2006/0091232 | A1 | 5/2006 | Grant |
| 2006/0249594 | A1* | 11/2006 | Pinch ..... 239/222.21 |

* cited by examiner

*Primary Examiner*—Christopher S. Kim
(74) *Attorney, Agent, or Firm*—Nixon & Vanderhye, PC

(57) ABSTRACT

A sprinkler head includes: a body assembly including an adapter, a nozzle, a spindle and a first magnet, the spindle supporting a spool having a pair of axially-spaced radially-oriented spool flanges; a nutating cage loosely mounted on the spindle, between the radial flanges of the spool, the nutating cage supporting a second magnet in close proximity to the first magnet; a water distribution plate carried by the nutating cage and adapted to be impinged upon by a stream emitted from the nozzle. The first and second magnets are arranged with like poles facing each other such that the second magnet is repulsed from the first magnet, but when the stream impinges on the water distribution plate, the second magnet is moved towards the first magnet, with magnetic repulsion force increasing and causing the nutating cage and the water distribution plate to tilt off axis.

8 Claims, 7 Drawing Sheets

SPRINKLER WITH MAGNETIC NUTATING MECHANISM AND RELATED METHOD

BACKGROUND OF THE INVENTION

This invention relates to sprinkler heads and, more particularly, to sprinkler heads that nutate while they rotate to minimize the "donut effect" prevalent with conventional non-nutating sprinkler heads.

Various nutating or wobbling sprinkler head designs have been available but with potential shortcomings that can nullify the very nutating effect that makes such sprinklers attractive in the first instance. Examples of known nutating or wobbling sprinkler heads may be found in prior U.S. Pat. Nos. 5,381,960; 5,950,927; and 6,932,279. Commonly owned U.S. Pat. Nos. 5,439,174; 5,588,595; 5,671,885; 6,267,299; and 6,439,477 provide further examples of nutating or wobbling sprinkler heads.

One problem often encountered with sprinklers of this type relates to stalling at start-up or during normal operation. Stalling occurs when the water distribution plate of the sprinkler head fails to tilt at start up, or ceases tilting during operation, thereby simply rotating and distributing a stream particularly susceptible to the "donut effect" where the wetted pattern area is shaped like a solid ring around a dry center. When nutating or wobbling sprinklers operate as designed, the nutating action tends to fill in the pattern in a substantially uniform manner. Thus, it is critical that the water distribution plate reliably and consistently remain in a tilted orientation while rotating to achieve the desired nutating action.

BRIEF SUMMARY

In one exemplary embodiment, a sprinkler head includes an adapter, nozzle body and spindle assembly that supports a nutating cage and water distribution plate. The cage is loosely supported on a double-flanged spool secured to the spindle, allowing the cage and water distribution to rotate and nutate about the spindle. The cage supports one magnet ring and the spindle supports another, in proximity to one another, with like poles facing each other. With this arrangement, and before water under pressure is supplied to the sprinkler head, the repulsion force between the magnets moves the cage and cage magnet along the spindle spool away from the spindle magnet which, at the same time, draws the water distribution plate upwardly (in the orientation of FIG. 2) toward the spindle and nozzle. Because of the annular shape of the two magnets and their relative alignment, the water distribution plate is maintained in a non-tilted position, substantially perpendicular to the longitudinal center axis of the sprinkler head, when at rest.

When water under pressure is supplied to the sprinkler head, the force of the water on the water distribution plate pushes the plate, cage and cage magnet downwardly, toward the spindle magnet. As the cage magnet approaches the spindle magnet, the magnetic repulsion force increases, creating positional instability in the cage assembly, causing the cage and water distribution plate to tilt off-axis. So long as water emitted from the nozzle impinges on the deflection plate, pushing the cage magnet towards the spindle magnet, the distribution plate will remain tilted as it rotates, resulting in a nutating or wobbling motion as the distribution plate rotates.

In another exemplary embodiment, the spindle magnet lies axially between the spool flanges while the cage magnet forms the upper one of the two axially spaced spool flanges. The operation of the device remains substantially as described above.

In a third exemplary embodiment, the opposed magnets are located in a cap assembly incorporating the water distribution plate and located downstream of the sprinkler nozzle and spindle. Here again, at rest, the repulsion force pushes the water distribution plate (and cage magnet) away from the fixed magnet in the cap assembly, and maintains the water distribution plate in a substantially non-tilted position. When water under pressure strikes the distribution plate, causing it to rotate, the magnetic force between the pair of magnets increases to destabilize the distribution plate and to cause it to tilt.

In still another embodiment, the components are generally as described above in connection with the second embodiment but, in this case, the fixed magnet is seated in a stationary strut assembly surrounding the cage and distribution plate.

Thus, in accordance with one aspect, there is provided a sprinkler head comprising: a body assembly including an adapter, a nozzle, a spindle and a first magnet, the spindle supporting a spool having a pair of axially-spaced radially-oriented spool flanges; a nutating cage loosely mounted on the spindle, between the radial flanges of the spool, the nutating cage supporting a second magnet in close proximity to the first magnet; a water distribution plate carried by the nutating cage and adapted to be impinged upon by a stream emitted from the nozzle, and wherein the first and second magnets are arranged with like poles facing each other such that the second magnet is repulsed from the first magnet, but when the stream impinges on the water distribution plate, the second magnet is moved towards the first magnet, with magnetic repulsion force increasing and causing the nutating cage and the water distribution plate to tilt off axis.

In another aspect, a nutating head assembly for use with a sprinkler is provided, the assembly comprising a housing formed with a center cavity defined in part by a cylindrical wall supporting a spool retainer ring; a first magnet supported in a base portion of the cavity; a spool assembly including a pair of radial flanges or opposite ends of a spacer ring, the spool assembly loosely confined on the retainer ring; the spool assembly comprising an upper hub component supporting a water distribution plate and a lower hub component supporting a second magnet located in proximity to the first magnet, the first and second magnets having like poles facing each other.

In still another aspect, there is provided a method of generating a nutating movement in a sprinkler water distribution plate as the plate rotates comprising: mounting a water distribution plate provided with at least one drive groove loosely on a sprinkler body such that the water distribution plate is free to nutate and rotate; utilizing a pair of magnets with like poles facing each other move the water distribution plate in a first direction to a non-tilted orientation when at rest; utilizing water under pressure impinging on the at least one drive groove in the water distribution plate to move the water distribution plate in an opposite direction such that repulsion forces between the pair of magnets is increased, thereby causing the water distribution plate to move to a tilted orientation that is maintained as the water distribution plate rotates due to the water under pressure impinging on the at least one drive groove.

The exemplary embodiments will now be described in detail in connection with the drawings identified below.

DETAILED DESCRIPTION OF THE DRAWINGS

Figure 1:
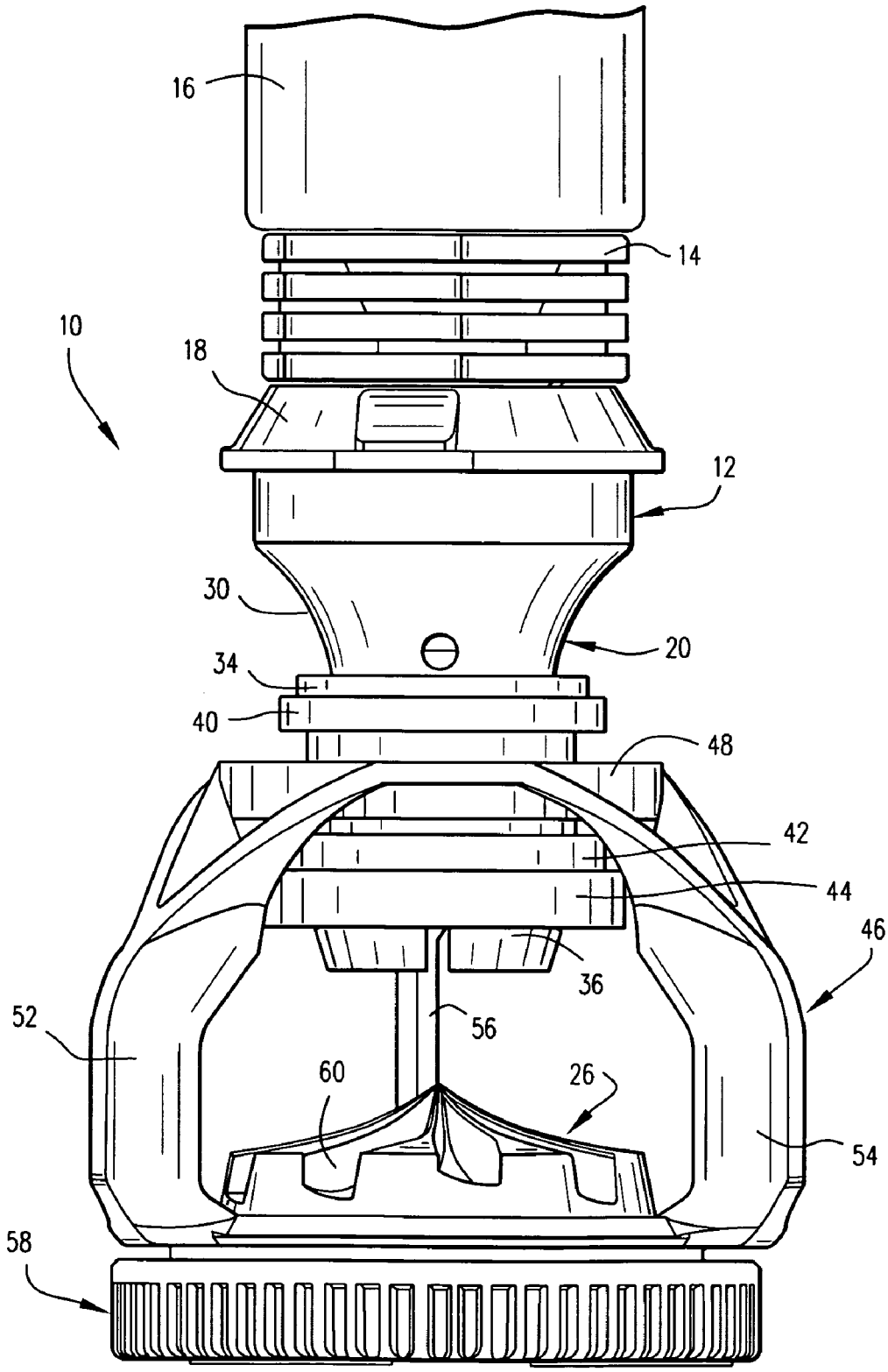
FIG. 1 is a front elevation of a sprinkler head in accordance with a first exemplary embodiment.
Figure 2:
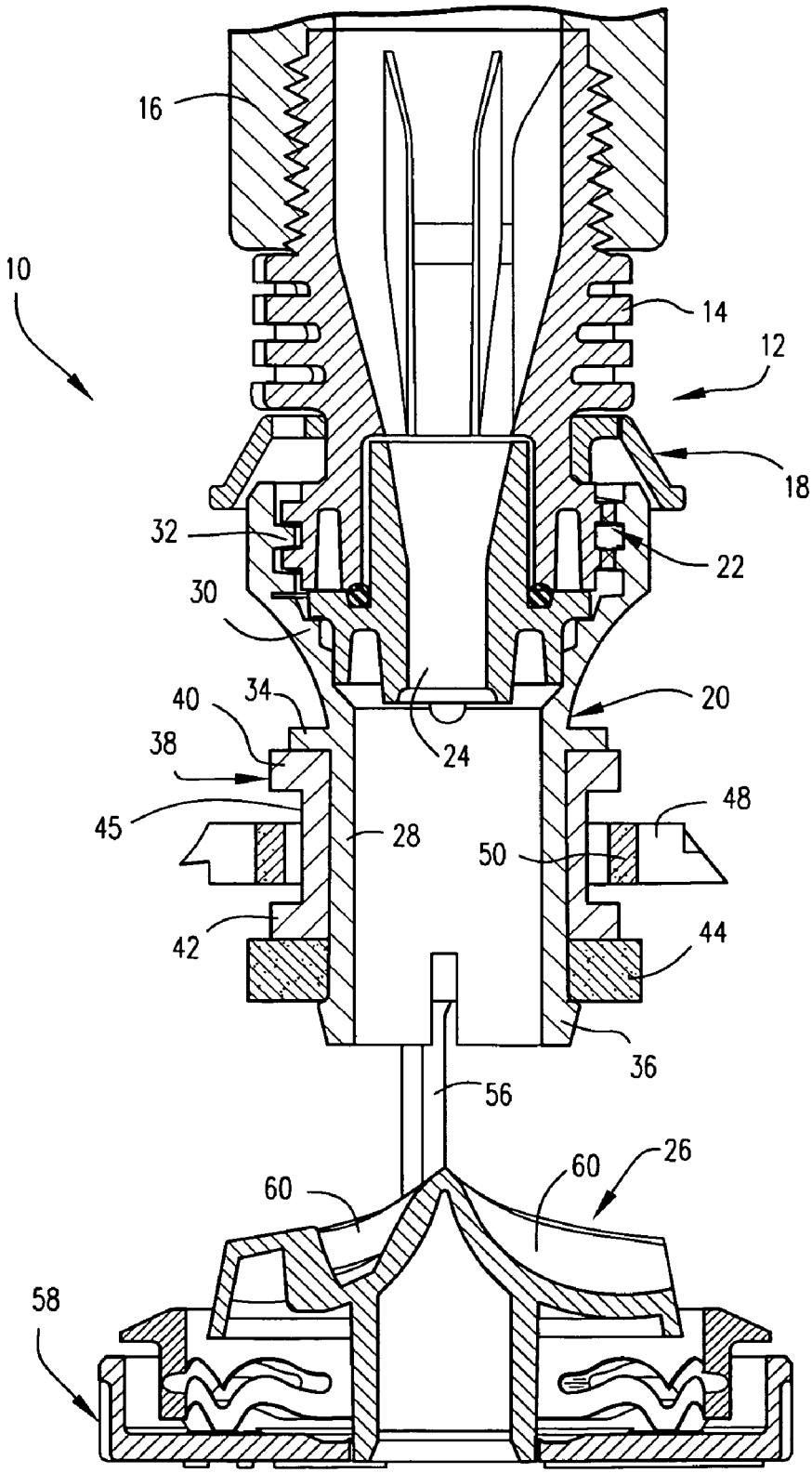
FIG. 2 is a cross section taken along the longitudinal center axis of the sprinkler head in FIG. 1.

With reference to FIGS. 1 and 2, a sprinkler head 10 includes a sprinkler body assembly 12 made up of an adaptor 14 for securing the sprinkler head to a flexible conduit, fixed riser or other irrigation component 16; a nozzle body 18; and a spindle 20. As best appreciated from FIG. 2, the nozzle body 18 is sandwiched between the adaptor 14 and the spindle 20 which are secured together via a threaded connection at 22 (FIG. 2). The nozzle body 18 is formed with an orifice 24 that emits a solid stream of water that passes through the spindle 20 to atmosphere, and toward a distribution plate 26 described further hereinbelow.

The spindle 20 is formed with a substantially cylindrical portion 28 (FIG. 2) that widens into a cone-shaped portion 30. The cone-shaped portion receives a portion of the nozzle body and is provided with internal threads 32 for the connection 22. The cylindrical portion 28 is delineated by a pair of radial flanges 34, 36 at opposite ends thereof. A double-flanged spool 38 is interference-fit (or otherwise suitably secured) over the cylindrical portion 28, with radial flanges 40, 42 at opposite ends, such that flange 40 is engaged with flange 34 of the spindle. A spindle magnet ring 44 is pushed onto the spindle portion 28 (over the compressible flange 36), sandwiched between the spool flange 42 and the spindle flange 36.

The water distribution plate 26 is part of a nutating head assembly that includes a three-spoke cage 46 (FIG. 1), one end of which is formed with an annular ring 48 located loosely between the spool flanges 40, 42. A cage magnet ring 50 is located about the inner diameter of the cage ring 48. The three spokes 52, 54 and 56 of the cage 46 extend away from the spindle 20 and support the water distribution plate 26 within an otherwise conventional cap assembly 58. The plate 26 is formed with integral grooves 60 that redirect the stream emitted from the nozzle orifice 24 in a substantially radial direction. In addition, the grooves 60 are curved in a circumferential direction so that the water causes the entire nutating head assembly to rotate about the spool 38. The loose fit of the nutating head assembly on the spool 38 causes the assembly, including the distribution plate 26, to nutate as it rotates, thus insuring a more uniform sprinkling pattern.

In order to prevent stalling during operation, it is desirable to insure that the distribution plate 26 tilts on start-up with respect to an axis extending through the center of the sprinkler head 10 and through the nozzle orifice 24. Accordingly, the spindle magnet ring 44 and the cage magnet ring 50 are located adjacent each other, with like poles facing each other (FIG. 2). When at rest, therefore, the magnetic repulsion force between the two magnet rings 44, 50 pushes the cage and cage magnet 50 (and the distribution plate 26) upward along the spool hub 45, away from the spindle magnet 44. Because the force is relatively uniform about the circumference of the magnet rings, the plate 26 is held in a non-tilted or horizontal position, i.e., substantially perpendicular to the sprinkler axis (as shown in FIGS. 1 and 2).

When water is supplied under pressure to the sprinkler head 10, the pressure of the stream impinging on the distribution plate 26 will push the cage 46 and plate 26 downwardly, such that the cage magnet 50 approaches the spindle magnet 44. As the cage magnet 50 approaches the spindle magnet 44, the repulsion force between the magnets increases, creating instability which causes the cage 46 and distribution plate 26 to tilt off-axis (see FIG. 3) and begin rotating about the spindle 20 in a nutating or wobbling fashion. Note that spool 40 may be made of a suitable wear-resistant material or have a suitable wear-resistant coating applied over wear-prone surfaces thereof. So long as water under pressure is impinging on the distribution plate 26, the instability of the distribution plate orientation is maintained, thereby preventing a stalling or equilibrium condition where the distribution plate 26 and cage assembly rotate but without the desired nutating action.

In the exemplary embodiment described above, note that there need not be any fixed struts or spokes surrounding the nutating head assembly, eliminating the problem of local water drip-off or drool that leads to excess water collection surrounding the sprinkler head.

Figure 3:
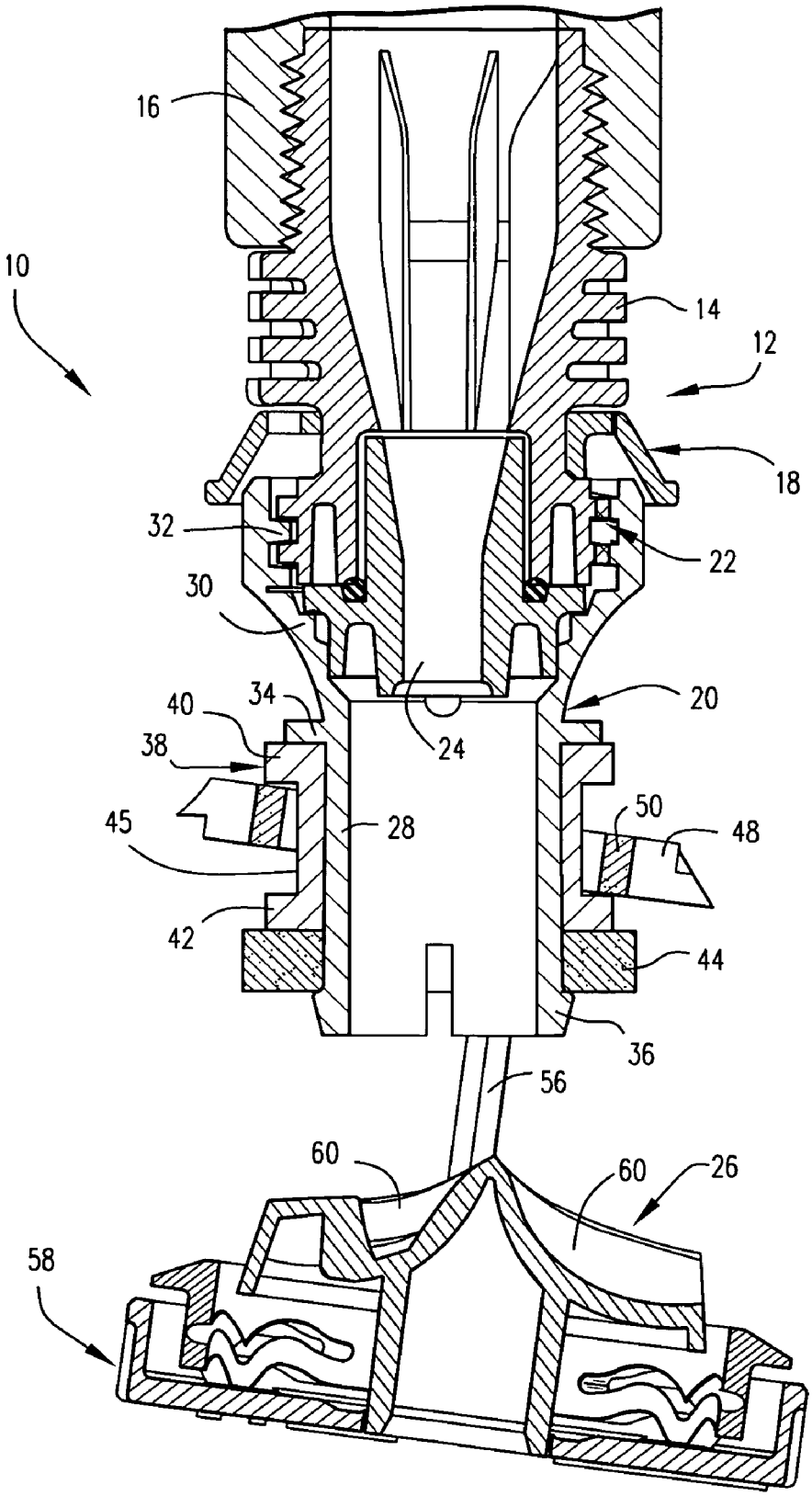
FIG. 3 is a section similar to FIG. 1 but showing the water distribution plate in a tilted or off-axis position.
Figure 4:
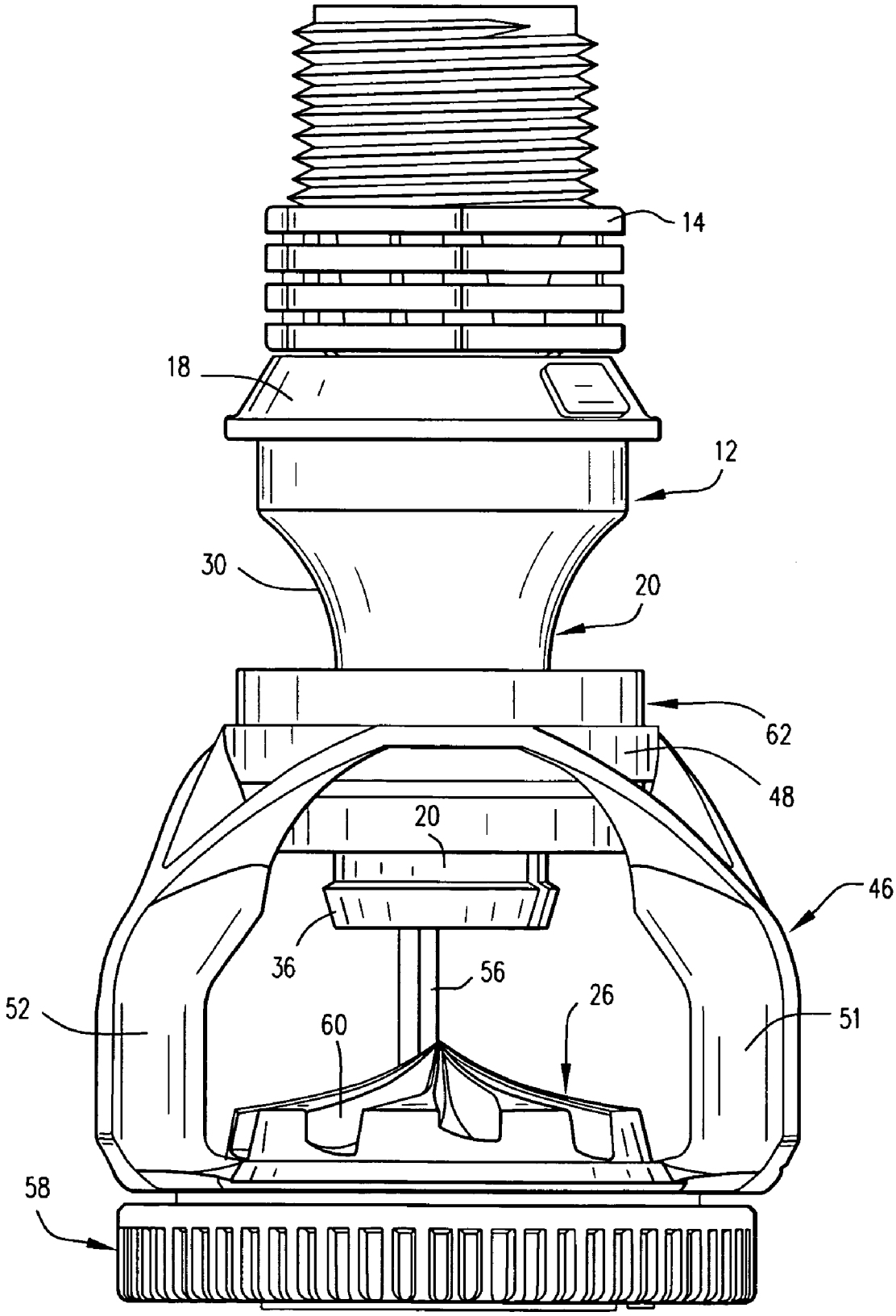
FIG. 4 is a front elevation of a sprinkler head in accordance with a second exemplary embodiment.
Figure 5:
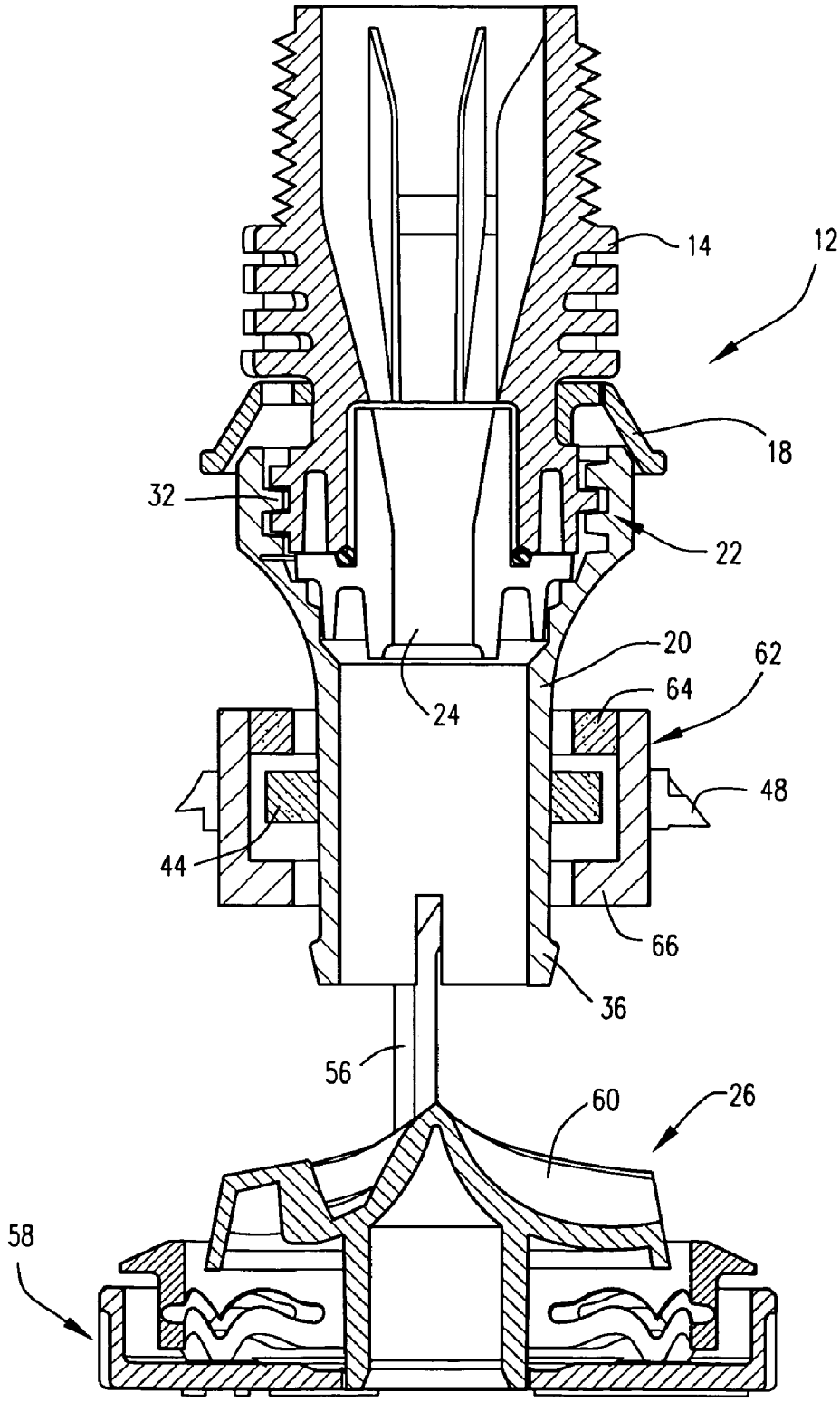
FIG. 5 is a cross section taken along the longitudinal center axis of the sprinkler head in FIG. 1.

In another exemplary embodiment illustrated in FIGS. 4 and 5, the spindle and cage magnets are relocated to different positions relative to one another. For ease of comparison, similar reference numerals are used to designate components corresponding to those used in FIGS. 1-3. In this embodiment, a spool 62 (FIG. 5) is employed that is formed with spool flanges 64, 66 facing radially inwardly towards the spindle 20, and the spindle magnet 44 is relocated axially along the spindle to a fixed position between the spool flanges. At the same time, the upper spool flange 64 and the cage magnet are integrated as a single component, i.e., the cage magnet and upper spool flange 64 are one and the same. Spool 22 is also connected directly to the cage ring 48. In use, the sprinkler head of FIGS. 4, 5 operates substantially identically to the embodiment shown in FIGS. 1-3, noting, however that in this case, the cage 46 nutates with the spool 62 about the spindle 20 and fixed spindle magnet 44.

Figure 6:
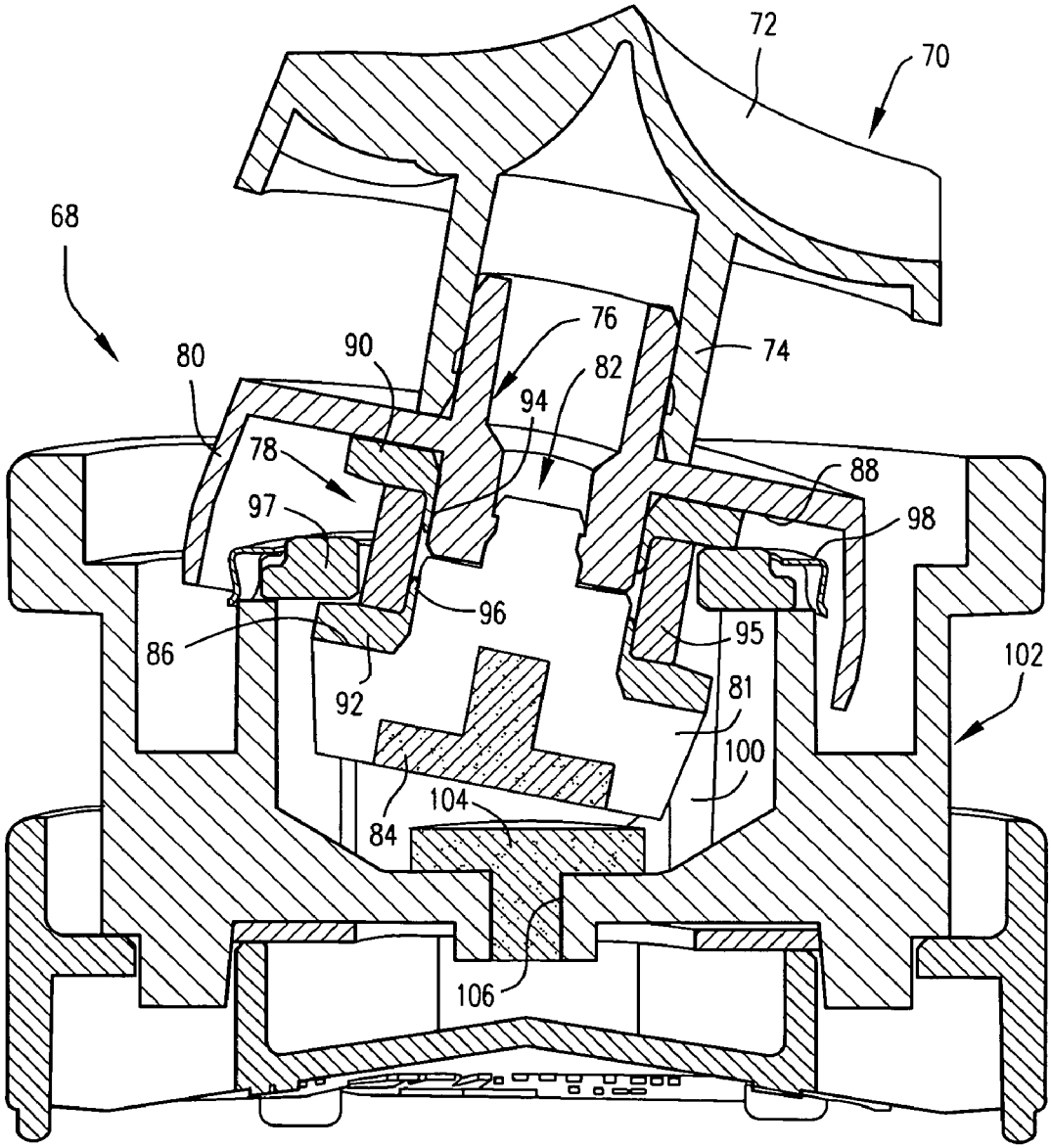
FIG. 6 is a section view taken through a sprinkler head in accordance with a third exemplary embodiment.

In another exemplary embodiment shown in FIG. 6, a nutating head assembly 68 is incorporated into a sprinkler head cap assembly that includes a water distribution plate 70 provided with distribution grooves 72 similar to those described in connection with the embodiments of FIGS. 1-5 that cause the plate to rotate when impinged upon by a stream emitted from a nozzle (not shown). A cylindrical stem 74 of the plate is telescopically received over an upper hub component 76 of a spool assembly 78, in a snap-fit or other suitable attachment arrangement. The upper hub component is shaped to provide an umbrella-like shield 80 that substantially encloses the spool assembly, preventing ingress of debris that might otherwise hamper the nutating action of the head.

A lower hub component 81 is press and snap-fit into the upper hub component 76 at 82. The lower hub component is formed with a first inverted magnet T-shaped disc 84 embedded therein. The lower hub component 81 is also formed with an external annular shoulder 86 and the spool assembly 78 is sandwiched between the shoulder 86 and the underside surface 88 of the shield 80. The spool assembly 78 comprises upper and lower rings 90, 92, each of which has a cylindrical component 94, 96, respectively, which enable the rings to be telescoped over the upper and lower hub components. The rings 90, 92 are separated by a sleeve or spacer 95 that serves as the spool hub.

The spool assembly 78 is loosely secured within an outside ring 97 that may be made of suitable wear-resistant material, such as a ceramic. An annular retainer 98 holds the ring 97 in place. The lower hub component is thus received in a center cavity 100 formed in the body 102 of the cap assembly. At the base of the cavity, a second magnet disc 104 is seated within an aperture 106. Magnet discs 84 and 104 are in opposing relationship, again with like poles facing each other. As in the previously described embodiment, when the sprinkler is at rest, the repulsion force between the magnets are substantially uniform and maintain the distribution plate 70 in a substantially non-tilted position. When a stream from the nozzle (not shown) impinges on the plate 70, however, the nutating head assembly 68 (and magnet disc 84) is pushed towards the magnet disc 104, with increased repulsion forces causing instability and resultant tilting of the assembly 68 to an off-axis position as shown in FIG. 6. The magnetic repulsion forces maintain the tilted orientation, enabling the desired nutating action during rotation, and preventing undesirable stalling.

It should also be noted that the lower hub component 81 may be constructed of any suitably heavy metal material, e.g., brass, to also serve as a counterweight that promotes a controlled nutating action of the assembly 68 as it rotates.

Figure 7:
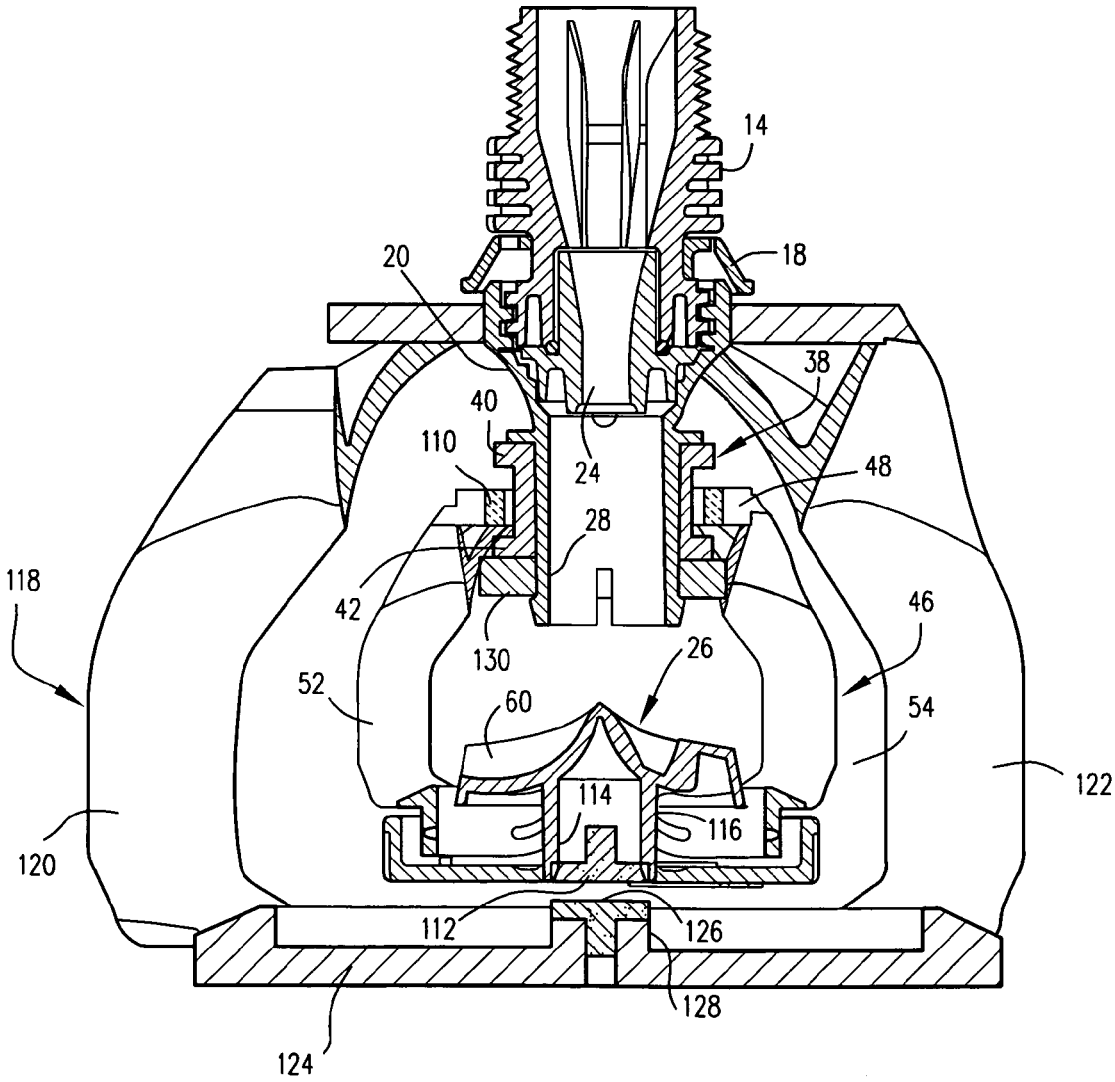
FIG. 7 is a section view taken through a sprinkler head in accordance with a fourth exemplary embodiment.

FIG. 7 illustrates yet another exemplary embodiment that is generally similar to the embodiments disclosed in FIGS. 1-3, but where the magnets have been relocated to an area remote from the spool assembly. More specifically, the cage magnet ring 50 has been replaced by a wear ring 110, and a cage magnet disc 112 has been press-fit into the open end 114 of a hub 116 on the back side of the water distribution plate 26. An outer cage 118 is supported at one end on the spindle 20 and includes plural (e.g., 3) struts (two shown at 120, 122) connected at an opposite end to a plate 124. A second magnet 126 is press-fit or otherwise secured in a centrally-located bushing 128 in the plate 124, in juxtaposed relationship to the first magnet 112. This magnet serves the same role as magnet 44 in FIGS. 1 and 2, and note that magnet 44 has been replaced in FIG. 7 by a fixed support ring 130. Here, the support of the cage 46 and distribution plate 26 on the spool via rings 48 and 110 on the spool 38 is substantially identical to the arrangement in FIGS. 1 and 2. This embodiment operates in substantially the same manner as the embodiments disclosed hereinabove. Thus, absent water under pressure, the repulsion force between magnets 112 and 126 raises the cage 46 and water deflection plate upwardly but in a centered or on-axis position. When the plate 26 is impinged upon by a stream emitted from the nozzle orifice 24, the cage 46, water deflection plate 26 and disc 112 are moved toward the magnet disc 126, increasing the repulsion force and causing the distribution plate 26 (and cage 46) to tilt to an off-axis position, resulting in the desired nutating action during rotation.

While the examples above have been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A sprinkler head comprising:

a body assembly including an adapter, a nozzle, a spindle and a first magnet, said nozzle located within said spindle, said spindle supporting a spool slidably received over said spindle and having a pair of axially-spaced radially-oriented spool flanges, wherein said first magnet is located between a lower one of said spool flanges and a downstream end of said spindle;

a nutating cage loosely mounted on said spindle, said nutating cage supporting a second magnet in close proximity to said first magnet;

a water distribution plate carried by said nutating cage and adapted to be impinged upon by a stream emitted from the nozzle, and wherein said first and second magnets are arranged with like poles facing each other such that said second magnet is repulsed from said first magnet, but when said stream impinges on said water distribution plate, said second magnet is moved towards said first magnet, with magnetic repulsion force increasing and causing said nutating cage and said water distribution plate to tilt off axis.

2. The sprinkler head of claim 1 wherein said second magnet is located between said pair of spool flanges.

3. The sprinkler head of claim 1 wherein spindle terminates at a downstream end in a first radial spindle flange, said first magnet sandwiched between said radial spindle flange and said lower one of said spool flanges.

4. The sprinkler head of claim 1 wherein said first and second magnets are formed as annular rings.

5. The sprinkler head of claim 3 wherein said nozzle includes an orifice located axially closer to an upstream end of said spindle than to said downstream end of said spindle.

6. The sprinkler head of claim 1 wherein said spindle is threadably engaged with said adapter, with said nozzle sandwiched between said spindle and said adapter.

7. The sprinkler head of claim 1 wherein said spindle is formed with a second radial spindle flange upstream of said first radial spindle flange, wherein an upper one of said spool flanges engages said second radial spindle flange.

8. A sprinkler comprising an adapter and a hollow spindle with a nozzle secured between one end of said adapter and an adjacent end of said spindle, said spindle extending beyond said nozzle in a downstream direction terminating at an opposite end, said spindle supporting a spool downstream of said nozzle, said spool having upper and lower radial flanges, and a first annular magnet axially between said lower radial flange of said opposite end of said spindle;

a nutating cage loosely mounted on said spindle, said nutating cage supporting a second magnet in close proximity to said first magnet; and a water distribution plate carried by said nutating cage and adapted to be impinged upon by a stream emitted from the nozzle.

* * * * *